US005582213A

United States Patent [19]

Okawa

[11] Patent Number: 5,582,213

[45] Date of Patent: Dec. 10, 1996

[54] LOOP-FORMING APPARATUS IN A WEAVING MACHINE FOR PILE FABRIC

[75] Inventor: Mitsuhisa Okawa, Toyama-ken, Japan

[73] Assignee: YKK Corporation, Tokyo, Japan

[21] Appl. No.: 446,250

[22] Filed: May 22, 1995

[30] Foreign Application Priority Data

Jun. 8, 1994 [JP] Japan ..... 6-126152

[51] Int. Cl.[6] ..... D03D 27/00

[52] U.S. Cl. ..... 139/46; 139/48

[58] Field of Search ..... 139/46, 48, 47, 139/49, 50

[56] References Cited

U.S. PATENT DOCUMENTS

| | | | |
|---|---|---|---|
| 3,083,737 | 4/1963 | Mestral | 139/46 |
| 4,083,506 | 4/1978 | Mander et al. | 242/25 R |
| 4,429,722 | 2/1984 | Herzog . | |
| 4,721,135 | 1/1988 | Tsubata et al. | 139/46 |
| 5,419,375 | 5/1995 | Corain et al. | 139/50 X |

FOREIGN PATENT DOCUMENTS

| | | | |
|---|---|---|---|
| 0228029 | 7/1987 | European Pat. Off. . | |
| 57-14304 | 7/1980 | Japan | 139/49 |

*Primary Examiner*—Andy Falik

*Attorney, Agent, or Firm*—Hill, Steadman & Simpson

[57] ABSTRACT

A loop-forming apparatus of the type including a plurality of loop-forming mandrels each extending forwardly between and in parallel to a corresponding adjacent pair of ground warp threads beyond the cloth fell of a weaving machine. The apparatus has at least one leno deflector extending transversely of the mandrels and reciprocally movable in a substantially transverse direction to that of the length of the mandrel so as to deflect the course of loop-forming warp threads alternately to one side and then to the other side of corresponding mandrels, respectively. A plurality of pairs of spaced gate hooks each extend vertically at opposite sides of the corresponding one of the mandrels and are vertically reciprocable in timed relation to the leno deflector to capture and lower the deflected loop-forming warp thread alternately to opposite sides of the corresponding mandrel so as to pass the loop-forming warp thread over the mandrel to thereby form pile loops on a woven fabric. Operation controls intermittently control the reciprocating operation of the leno deflector at given intervals of time so as to form loop-forming surfaces and loop-free surfaces alternately in the weaving direction on the woven fabric.

7 Claims, 6 Drawing Sheets

LOOP-FORMING APPARATUS IN A WEAVING MACHINE FOR PILE FABRIC

BACKGROUND OF THE INVENTION

1. Field of the Invention

The present invention relates to improvements in a loop-forming apparatus in a weaving machine for pile fabric, especially for weaving a web of surface fastener, and more particularly to such a loop-forming apparatus which is capable of arbitrarily defining the area of a loop-forming portion on a ground fabric woven continuously.

2. Description of the Prior Art

A known loop-forming apparatus in a weaving machine, for instance, as disclosed in Japanese Patent Laid-open Publication No. 57-14304, comprises a plurality of leno healds each including a pair of vertical guide wires having their central portions bent into an S shape and disposed on opposite side of a corresponding loop-forming bar or mandrel, and an inverted A-shaped half heald operatively interlocked with the guide wires and having at its bent portion an eyelet through which a loop-forming warp thread is threaded. The guide wires descend in alternate turns to lower the half heald to bring down the loop-forming warp thread alternately to one side and then to the other side of the loop-forming mandrels so as to pass the loop-forming warp thread over the mandrel, and thus forming a loop of the thread.

The known loop-forming apparatus has a drawback that it cannot cope with the trend of a high speed weaving machine, necessarily involves generation of unpleasant operation noise, and requires replacement of component parts having a relatively short period of use because the guide wires and halfheald operate with mutual physical contact. Another problem is that the conventional loop-forming apparatus requires a pair of guide wires and a half heald for a single loop-forming mandrel, which makes the apparatus complex with such an increased number of component parts as a whole.

The foregoing problems have been solved by a loop-forming apparatus disclosed, for example, in Japanese Patent Publication No. 1-39761 (U.S. Pat. No. 4,721,135). The disclosed loop-forming apparatus comprises a plurality of parallel spaced loop-forming mandrels each extending forwardly between and in parallel with respective adjacent pairs of ground warp threads beyond a cloth fell of a weaving machine, a leno deflector reciprocally movable in a transverse direction of the loop-forming mandrels for deflecting the course of loop-forming warp threads alternately to one side and then to the other side of the corresponding loop-forming mandrels, and a plurality of pairs of spaced gate hook bars each extending vertically at the opposite sides of the corresponding one of the loop-forming mandrels and vertically reciprocable to capture the laterally deflected loop-forming warp thread and then lower the same thread alternately at one side and then to the other side of the corresponding loop-forming mandrel to thereby form a loop of the thread. The thus arranged loop-forming apparatus is simple in construction having a reduced number of component parts, is capable of operating at a high speed by virtue of respective operative parts held out of mutual interference, and is free from any trouble caused by interference between adjacent loop-forming warp threads.

The loop-forming apparatus disclosed in the publications specified above and other conventional loop-forming apparatus incorporated in the weaving machines for weaving a web of surface fastener are so constructed as to form a plurality of rows of loops continuously as the weaving of a ground fabric progresses. They have neither an intention of alternately forming a loop-forming surface and a loop-free surface, nor the idea of restricting a loop-forming surface within a given area.

The surface fasteners are used in various ways. In one mode of application, they are used on a fastening portion or area of a binding or fastening strip in which instance the binding strip as a whole may be composed of a surface fastener tape having male or female interlocking elements, and a piece of surface fastener tape having female or male interlocking elements is attached to one end portion of the back surface of the binding strip. In the binding strip, however, these interlocking elements which are located on a portion other than the fastening portion are left unused and hence can be dispensed with. Accordingly, if the interlocking elements could be formed only on the necessary portion of a binding strip at the time of weaving of the binding strip, a considerably improvement in the productivity should be provided with the resultant reduction of cost. In recent years, the surface fasteners have found their application for an attachment device for curtains. In this case, it would be particularly advantageous if a first surface having male or female interlocking elements and a second surface free from interlocking elements could be formed at a given interval while restricting the respective areas of the first and second surfaces.

The above-described conventional weaving machines, however, cannot produce loop-forming surfaces and loop-free surfaces arranged alternately. If an attempt to form the loop-forming surfaces and loop-free surfaces alternately were made on a weaving machine equipped with the leno-heald type loop-forming apparatus, it would require a large-sized chain and cam mechanism which will enlarge the overall size of the apparatus, and also need the use of an expensive weaving machine such as a jacquard machine or a dobby machine.

SUMMARY OF THE INVENTION

With the foregoing drawbacks of the prior art in view, the present invention contemplates improvements in the loop-forming assembly or apparatus disclosed in Japanese Patent Publication No. 1-39761 (U.S. Pat. No. 4,721,135) and has for its object the provision of an improved loop-forming apparatus incorporated in a weaving machine for weaving a web:of surface fastener, which apparatus is simple in construction but is capable of forming loop-forming surfaces and loop-free surfaces alternately at given intervals while restricting the respective areas of these two surfaces, or forming first areas each having pile loops for forming male or hook-shaped interlocking elements and second areas each having pile loops forming female or looped interlocking elements and arranged alternately with the first areas.

According to the present invention, a loop-forming apparatus incorporated in a weaving machine for weaving a web of surface fastener having a multiplicity of warp pile loops formed of loop-forming warp threads on one side thereof comprises: a plurality of parallel spaced loop-forming mandrels each extending forwardly between and in parallel to a corresponding adjacent pair of ground warp threads beyond a cloth fell of the weaving machine; at least one leno deflector extending transversely of the mandrels between the cloth fell and a harness of the weaving machine and reciprocally movable in a substantially axial direction thereof so as to deflect the course of the loop-forming warp threads alternately to one side and then to the other side of corresponding mandrels, respectively; a plurality of pairs of spaced gate hooks each extending vertically at opposite sides of the corresponding one of the mandrels, each pair of the gate hooks being vertically reciprocable in timed relation to the leno deflector to capture and lower the deflected loop-forming warp thread alternately to opposite sides of the corresponding mandrel so as to pass the loop-forming warp thread over the loop-forming mandrels in a staggering fashion to thereby form pile loops on a woven fabric; and operation control means for intermittently controlling the reciprocating operation of the leno deflector at given intervals of time.

In a preferred embodiment of the present invention, the leno deflector is reciprocally driven by a cam mechanism operatively coupled with a rotating power source, and the operation control means includes a clutch mechanism disposed between the rotating power source and the cam mechanism, and clutch control mechanism for arbitrarily controlling engaging and disengaging time periods of the clutch mechanism. As an alternative, the leno deflector is reciprocally driven by an electromagnetic driving means, and the operation control means includes an electromagnetic operation control means for arbitrarily controlling an operating time period of the electromagnetic driving means. In either case, the vertical reciprocating motion of the gate hooks may be maintained while reciprocating motion of the leno deflector is stopped.

According to another preferred embodiment, the number of the leno deflector is plural, and the plural leno deflectors are driven independently of one another at respective given intervals of time under the control of the operation controls means. In one preferred form, the loop-forming warp threads threaded through the leno deflectors are all composed of monofilaments or multifilaments. In another preferred form, a first group of the loop-forming warp threads threaded through one of the leno deflectors are composed of monofilaments, and a second group of the loop-forming warp threads threaded through an adjacent one of the leno deflector are composed of multifilaments.

In operation of the loop-forming apparatus, the leno deflector is moved transversely with respect to the length of the mandrels in one direction so that a plurality of loop-forming threads threaded through the leno deflector are deflected to one side of the corresponding mandrels transversely over and across the mandrels. Then, each pair of gate hooks is lowered to capture a corresponding one of the thus deflected loop-forming warp threads at a guide recess of one of the paired gate hooks and move the same down to the position below the level of the mandrel, whereat the loop-forming warp thread is temporarily retained to establish a shed of loop-forming warp threads. A weft thread is inserted in the shed and then beaten against the cloth fell, during which time the loop-forming warp thread extending around the mandrel is advanced therealong past the cloth fell to be interlaced with the beaten weft thread, thereby forming warp pile loops on a woven fabric.

The gate hooks then ascend to release the loopforming warp thread. Subsequently, the leno deflector is moved transversely with respect to the length of the mandrels in the opposite direction to deflect the same loop-forming warp thread to the other side of the mandrel, and at the same time, the gate hooks are lowered again to capture the deflected loop-forming warp thread at the guide recess of the other gate hook and move the same down to the position below the level of the mandrel, whereat the loop-forming warp thread is temporarily retained to establish a shed of loop-forming warp threads. The weft thread is then inserted in the shed and subsequently beaten against the cloth fell, thereby forming a next loop of the thread on the woven fabric. Thus, the woven fabric serving as a blank web of surface fastener with the warp pile loops woven thereinto is progressively formed and withdrawn forwardly away from the free ends of the mandrels.

In general, the foregoing cycle of operation is repeated so that a series of rows of transversely aligned pile loops are formed successively over the entire length of the woven fabric. The woven fabric has one side formed with a loop-forming surface. According to the present invention, however, it is possible to form a woven fabric having loop-forming surfaces and loop-free surfaces arranged alternately and each having a predetermined length. To this end, under the control of a program preset in the leno deflector drive control unit, a counter (not shown) counts up the number of cycles of operation of the weaving machine and when the count in the counter reaches a preset number, the leno deflector drive control unit sends an input signal to the operation control means or unit to stop reciprocating movement of the leno deflectors whereupon the loop-forming function of the apparatus is stopped. During that time, the gate hooks still continue their vertical reciprocation, so that the loop-forming warp threads open and close their shed without forming any loop and interwoven into the ground structure of the woven fabric. As a result of this operation, a loop-free surface which is devoid of pile loops on the woven fabric is produced. When the reciprocating movement of the leno deflectors is restarted according to a signal from the leno deflector drive control unit, successive rows of pile loops are formed continuously over a succeeding area of the woven fabric, and thereby forming a looped surface. During that time, the number of operation cycles of the weaving machine is counted continuously, and when a predetermined number of operation cycles is reached, the reciprocating movement of the leno deflectors is stopped again whereupon the operation is shifted from the looped-surface producing mode to the loop-free surface producing mode. The respective lengths of the loop-forming surface and the loop-free surface can be readily changed by properly setting the preset count number of the counter.

According to the loop-forming apparatus of the present invention, the pile loops used for forming the hook-shaped interlocking elements and the pile loops solely forming looped interlocking elements can be formed either alone or mixedly.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
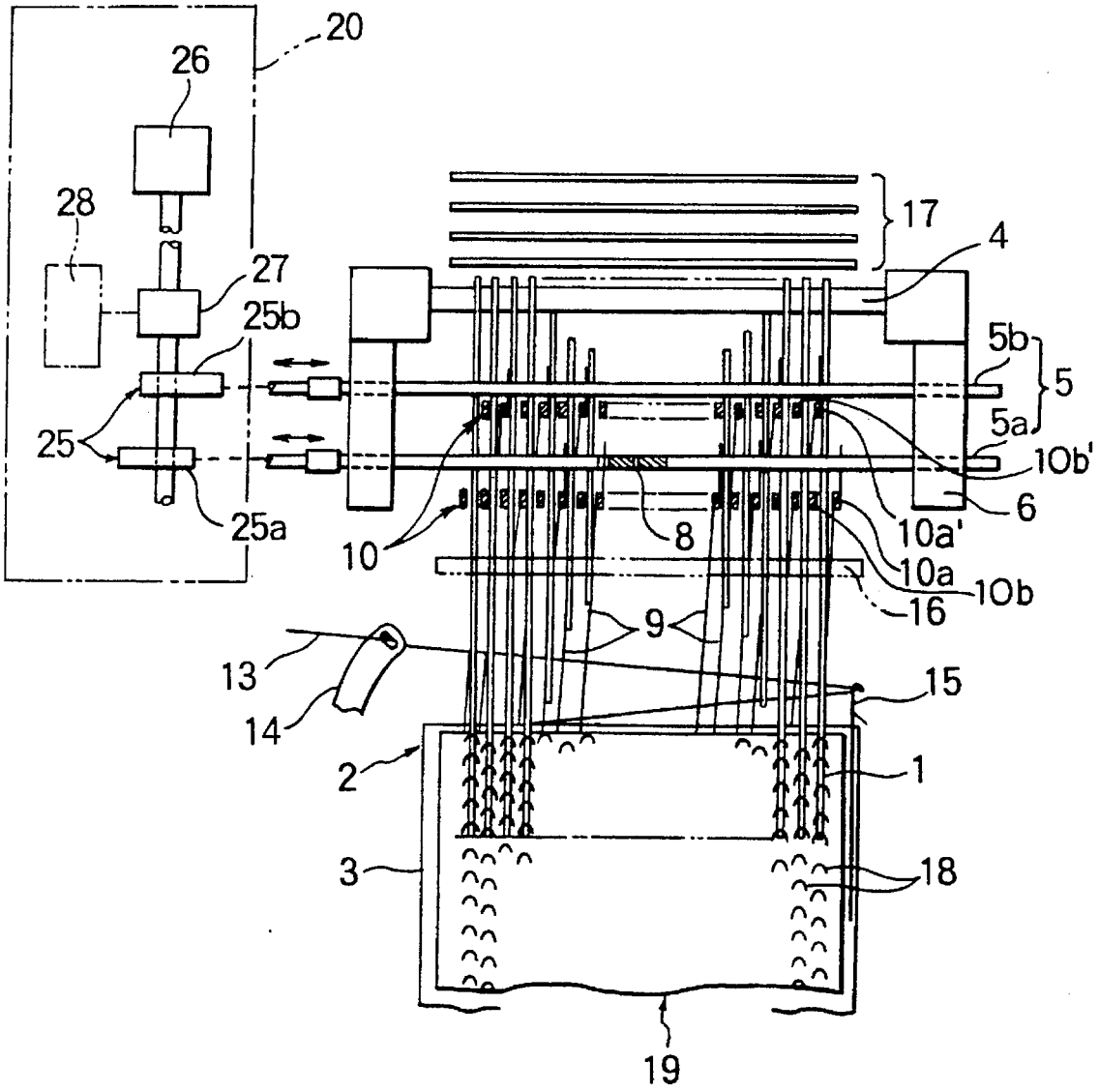
FIG. 1 is a schematic plan view of a main portion of a loop-forming apparatus according to one embodiment of the present :invention incorporated in a weaving machine for weaving a web of surface fastener.
Figure 2:
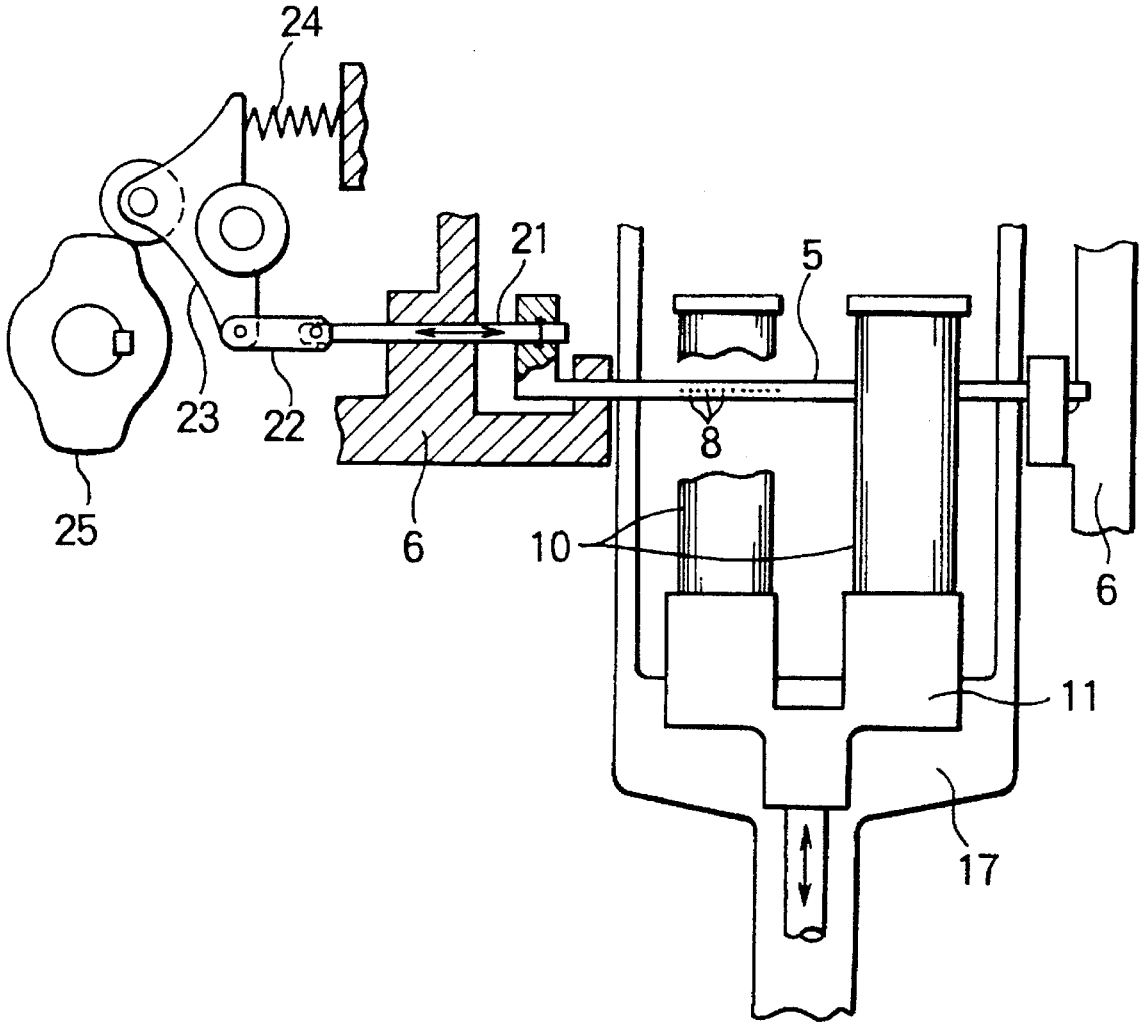
FIG. 2 is a front elevational view of the apparatus.
Figure 3:
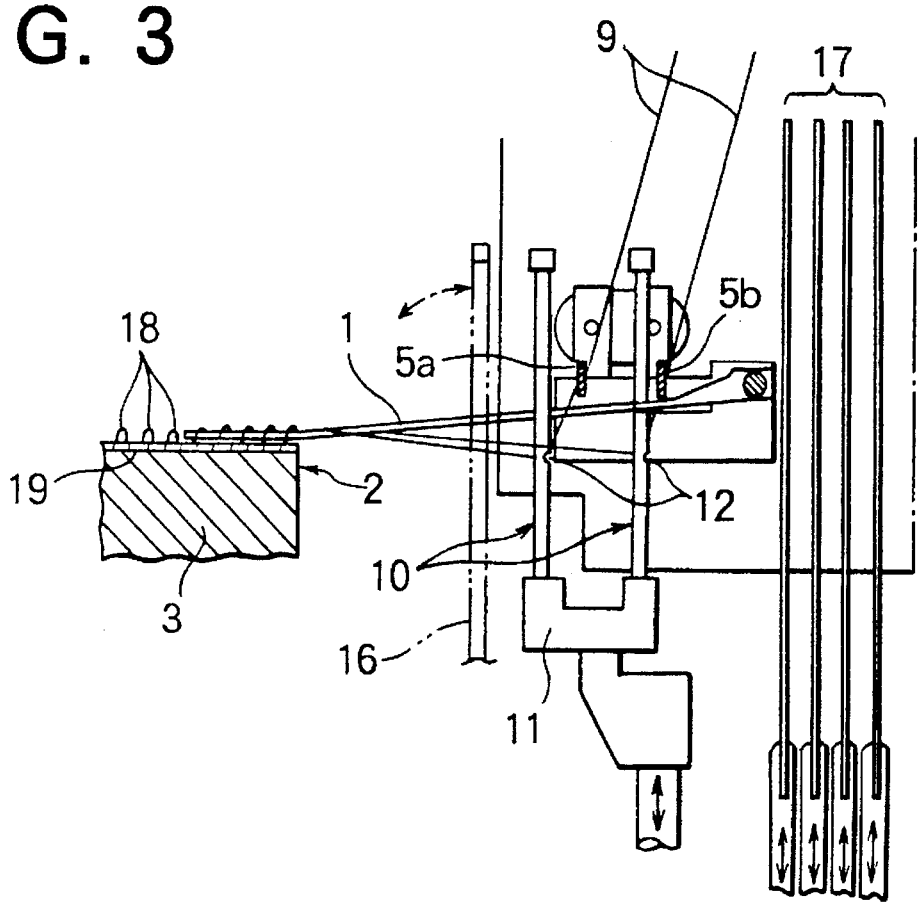
FIG. 3 is a schematic side view of the apparatus.

Certain preferred embodiments of the present invention will be described below in greater detail with reference to the accompanying drawings. FIGS. 1 through 3 schematically illustrate a main portion of a loop-forming apparatus according to one embodiment of the present invention. The loop-forming apparatus is incorporated in a weaving machine for weaving a woven fabric 19 serving as a blank web tape of a surface fastener or loop-and-hook fastener. The weaving machine includes a heald unit or harness 17 for forming a shed of ground warp threads (not shown for easy understanding of the construction of the apparatus), a reed 16 for beating up a weft thread 13, and a table 3 for supporting the woven fabric 19 thereon. The loop-forming apparatus is disposed between the harness 17 and the reed 16 and generally comprises a plurality loop-forming mandrels 1, at least one leno deflector 5 (two in the illustrated embodiment), a plurality of pairs of parallel spaced gate hooks 10, and an operation control means or unit 20 for intermittently operating the leno deflector 5 at given intervals of time.

The loop-forming mandrels (hereinafter referred to, for simplicity, as "mandrels") 1 are composed of a multiplicity of parallel spaced, cantilevered bars extending between and in parallel to respective adjacent pairs of ground warp threads. The cantilevered bars or mandrels 1 have one free end at one side extending forwardly over the woven fabric 19 beyond the cloth fell 2, and a fixed end on the other side firmly secured to a single support bar 4 which extends transversely of the ground warp threads (not shown). In FIG. 1, centrally located ones of the mandrels 1 have been omitted.

Figure 8:
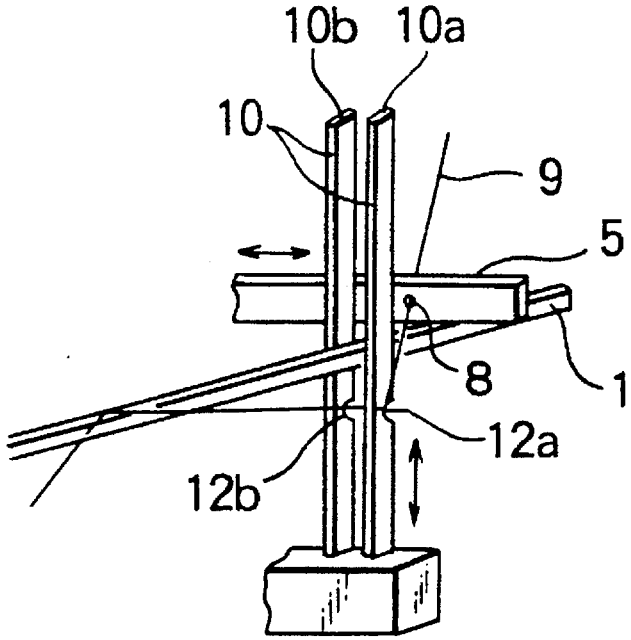
FIGS. 8 and 9 are schematic perspective views illustrative of the operation in which a loop is formed by the loop-forming apparatus of the present invention.
Figure 9:
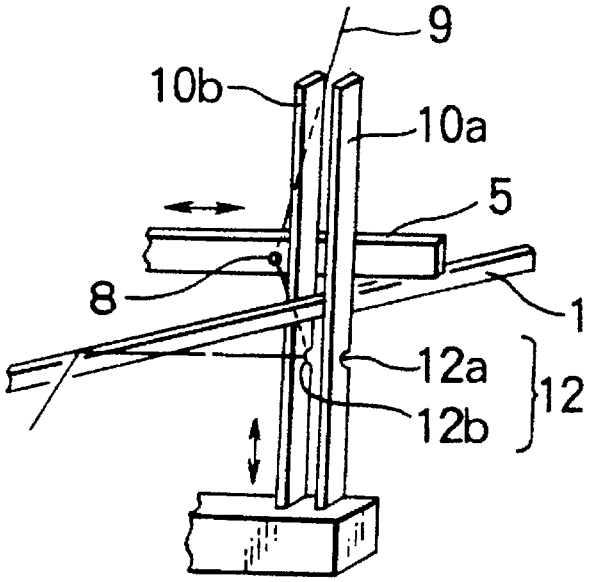

The leno deflectors 5 extend in the widthwise direction of the woven fabric transversely over and across the mandrels 1 at a position near the fixed ends of the mandrels 1, as shown in FIGS. 1 and 3. The leno deflectors 5 each have opposite ends slidably supported by a unitary guide 6 and are driven by a power source 26, such as an electric motor or an electromagnet, via piston rods 21 connected at respective one ends of the leno deflectors 5 to move substantially in a transverse direction with respect to the length of the mandrel 1 in a reciprocating manner. Each of the leno deflectors 5 has a series of eyelets 8 spaced longitudinally of the deflector 5 at predetermined pitches for the passage therethrough of loop-forming warp threads 9. Reciprocating movement of the leno deflectors 5 causes the loop-forming warp threads 9 received in the eyelets 8 to be deflected alternately to one side and then to the opposite side of the mandrels 1, as shown in FIGS. 8 and 9. In the illustrated embodiment, partly for the purpose of handling a larger number of loop-forming warp threads 9, and partly for the purpose of forming hooks and pile loops of the surface fastener either alone or in combination, as described later, the leno deflectors 5 are disposed in parallel juxtaposition such that the first or front leno deflector **5*a* has a plurality of eyelets 8 for receiving and deflecting a given even number group of loop-forming warp threads 9 with respect to corresponding ones of mandrels 1, and the second or rear leno deflector 5*b* has a plurality of eyelets 8 for receiving and deflecting an odd number group of the loop-forming warp threads 9 with respect to corresponding ones of mandrels 1. In the case that the number of leno deflectors 5 is more than two, such an order of an even and odd number groups of loop-forming warp threads to be received in the eyelets 8** may not be applied.

The paired gate hooks 10 each extend vertically at opposite sides of a corresponding one of the mandrels 1, as shown in FIG. 1. Every gate hook 10 has a central portion recessed to form a guide recess 12 for receiving the loop-forming warp thread 9. The paired gate hooks 10 are divided into two groups **10*a*, 10*b*;10*a*', 10*b*', one or first group 10*a*, 10*b* operatively associated with the first or front leno deflector 5*a* and the other or second group 10*a*', 10*b*' with the second or rear leno deflector 5*b*, as shown in FIGS. 1 and 2. The first and second groups 10*a*, 10*b*; 10*a*', 10*b*' of the gate hooks 10 are disposed immediately downstream of the leno deflectors 5*a*, 5*b*, respectively, and firmly secured at their lower ends to a support block 11. The support block 11 is vertically driven by a power source (not shown) to reciprocate the two groups of the gate hooks 10*a*, 10*b*; 10*a*',10*b*' simultaneously in timed relation to the transverse reciprocating movement of the leno deflectors 5*a*, 5*b*. The gate hooks 10*a*, 10*b*;10*a*', 10*b*', the mandrels 1 and the leno deflectors 5*a*, 5*b* are spaced apart one from another. As shown in FIG. 8 and 9, a pair of the gate hooks 10*a*, 10*b* or a pair of the gate hooks 10*a*', 10*b*' are situated in parallel to each other on opposite sides of one of the corresponding mandrels 1, and as shown in FIG. 1, the two pairs are arranged in such a manner that the gate hook 10*a*' stands behind 10*b* while 10*b*' stands behind 10*a*** in the weaving direction so as to avoid an objectionable mutual interference.

The operation control means or unit 20 provided for controlling the operation of the leno deflectors 5 constitutes an important feature of the present invention. FIGS. 1–3 describe one example of a control means or unit. In the embodiment shown in FIGS. 1–3, the operation control unit 20 includes a rocking member 23 connected via a link 22 to each of the piston rods 21, a driving cam 25 with which a portion of the rocking member 23 is resiliently held in contact under the force of a spring 24, a power source 26 for drivingly rotating the driving cam 25, an electromagnetic clutch 27 for intermittently engaging and disengaging the connection of the driving cam 25 and the power source 26, and a leno deflector drive control unit 28 for controllingly operating the electromagnetic clutch 27. The leno deflector drive control unit 28 serves also as a clutch control means or unit.

The rocking member 23, as shown in FIG. 2, is composed of a plate in the shape of a substantially right-tangled isosceles triangle having a hypotenuse pivotally connected at its central portion to a frame (not shown) of the apparatus. A vertex at the right angle of the isosceles triangle freely rotatably supports thereon a cam follower in the form of a contact roller (not designated), one of the two remaining vertices of the isosceles triangle is connected to one end of the link 22, and the other of the two remaining vertices is urged by the spring 24 so that the contact roller is resiliently held in contact with a cam surface of the driving cam 25. To cope with the first and second leno deflectors 5*a*, 5*b* disposed in parallel juxtaposition, all of the components of the operation control unit 20 are two in number except the electromagnetic clutch 27 and two such components are operatively connected with the first and second leno deflectors 5*a*, 5*b*, respectively. In order to engage and disengage the electromagnetic clutch 27, the operation control unit 20 further includes a counter (not shown) for counting up the number of cycles of operation of the weaving machine. When the count in the counter reaches a preset number, the leno deflector control unit 28 issues a signal to engage and disengage the electromagnetic clutch 27. In the embodiment shown in FIGS. 1–3, the power source 26 is connected with a power source (not shown) of the weaving machine via a suitable power transmission mechanism including a chain, a belt, pulleys, gears and the like (neither shown) and drives the driving cams 25 in synchronism with the operation of the weaving machine.

Figure 10:
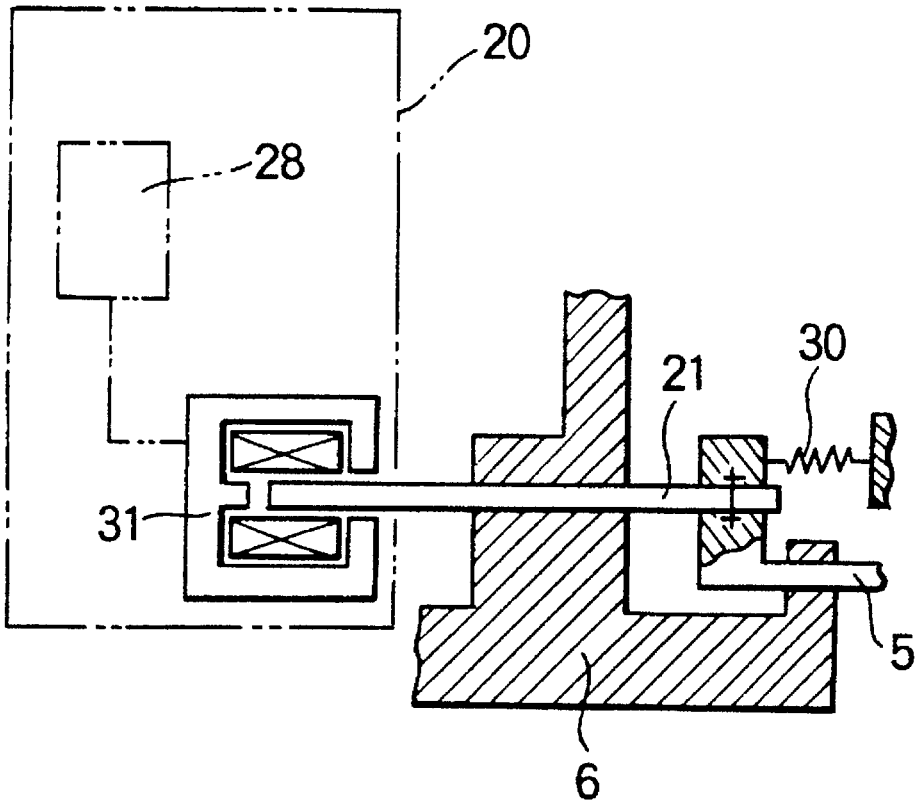
FIG. 10 is a schematic plan view, with parts in cross section, of a main portion of an operation control means for controlling operation of a leno deflector of the loop-forming apparatus of the present invention.

The operation control unit 20 should by no means be limited to the mechanism shown in FIGS. 1–3 but may include another mechanism which includes, as shown in FIG. 10, a spring 30 connected to each of the leno deflectors 5 to be urged the latter in the right-hand direction as viewed in FIG. 10, and an electromagnetic driving means 31, such as a solenoid having a movable core or piston rod 21, operatively connected to the left end of the corresponding leno deflector 5 for reciprocating the leno deflector 5 intermittently at desired intervals of time.

The operation of the loop-forming apparatus of the construction shown in FIGS. 1–3 will be described below with reference to FIGS. 8 and 9 in which only a single loop-forming unit of the apparatus is shown for the purposes of clarity as any one of these units operates in a similar manner.

The beat-up operation of the reed 16 is followed by the movement of the leno deflectors 5*a*, 5*b* in one or right-ward direction (as viewed in FIG. 8) until each of the leno deflector 5*a*, 5*b* reaches the position shown in FIG. 8 in which the eyelet 8 has passed completely across the mandrel 1 so that the loop-forming warp thread 9 threaded through the eyelet 8 is deflected to one or right-hand side of the mandrel 1. Then, the paired gate hooks 10 are lowered, and the guide recess 12*a* of the gate hook 10*a* captures the thus deflected loop-forming warp thread 9 and moves the same down to the right-hand position shown in FIG. 8 below the level of the mandrel 1, whereat the loop-forming warp thread 9 is temporarily retained to establish a shed of loop-forming warp threads 9. The weft thread 13 (FIG. 1) is now inserted from one edge of the woven fabric 19 through the shed by means of a weft inserter or filling carrier 14 disposed at one selvage side of the woven fabric 19 as shown in FIG. 1, and is caught by a latch needle 15 disposed at the other selvage side of the woven fabric 19. The reed 16 is then actuated to beat up the weft thread 13, during which time the loop-forming warp thread 9 extending around the mandrel 1 is advanced therealong past the cloth fell 2 to be interlaced with the beaten weft thread 13, thereby forming warp pile loops 18 on a ground structure of the woven fabric 19. The gate hooks 10 then ascend to release the loop-forming warp thread 9, and thus completing a first half cycle of the operation.

The Second half cycle of the operation begins with movement of the leno deflectors 5 to the other or leftward direction in FIG. 9 to deflect the same loop-forming warp thread 9 to the left-hand side of the mandrel 1 and stops the position shown in FIG. 9, whereupon the gate hooks 10 are lowered again, and the guide recess 12*b* of the gate hook 10*b* captures the deflected loop-forming warp thread 9 and moves the same down to the left-hand position shown in FIG. 9 below the level of the mandrel 1, whereat the loop-forming warp thread 9 is temporarily retained to establish a shed of loop-forming warp threads 9. The weft thread 13 is then inserted in the shed and subsequently beaten by the reed 16 against the cloth fell 2, during which time the loop-forming warp thread 9 is formed into a warp pile loop 18 in a similar manner to the first half cycle, and thus completing a second half cycle of the operation and hence one cycle of the operation.

This cycle is repeated by reciprocally moving the leno deflectors 5 and the gate hooks 10 in the horizontal and vertical directions, respectively, thereby forming a multiplicity of warp pile loops 18 on the woven fabric 19. During this operation, the upper and lower sets of the ground warp threads (not shown) are both moved by the healds of the harness 17 to open and close their shed (not shown) to form the ground structure of the woven fabric 19 jointly with the weft thread 13 in a well known manner. Accordingly, the woven:fabric 19 serving for instance as a blank web of surface fastener with the warp pile loops 18 woven thereon is progressively formed and withdrawn forwardly away from the free ends of the mandrels 1, as shown in FIG. 3.

Figure 4:
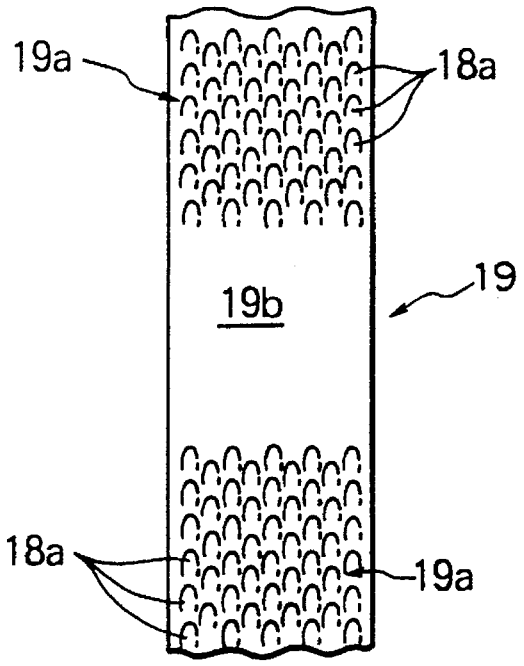
FIG. 4 is a fragmentary plan view of a surface fastener tape produced by the apparatus.

In general, the foregoing operation cycle is repeated so that rows of transversely aligned pile loops 18 are formed successively on the ground structure of a woven fabric 19. Accordingly, the woven fabric 19 solely has a loop-forming surface 19*a* (see FIG. 4) throughout the length thereof. According to the present invention, it is possible to form a woven fabric 19 having loop-forming surfaces 19*a* and loop-free surfaces 19*b* extending alternately in the weaving direction along respective predetermined lengths of the woven fabric 19. To this end, under the control of a program preset in the leno deflector drive control unit 28, the counter (not shown) counts up the number of cycles of operation of the weaving machine and when the count in the counter reaches a preset number, the leno deflector drive control unit 28 sends an input signal to the electromagnetic clutch 27 to engage or disengage the electromagnetic clutch 27. When the electromagnetic clutch 27 is disengaged, the reciprocating movement of the leno deflectors 5 is stopped whereupon their loop-forming function of the apparatus is stopped. During that time, the gate hooks 10 still continue their vertical reciprocation, so that the loop-forming warp threads 9 open and close their shed and interwoven into the ground structure of the woven fabric 19 without forming loops. As a result of this operation, a loop-free surface 19*b* which is devoid of pile loops on the ground structure of the woven fabric 19 is produced. When the electromagnetic clutch 27 is engaged by a signal issued from the leno deflector drive control unit 28, the reciprocating movement of the leno deflectors 5 is started again to form successive rows of pile loops 18 on a succeeding area of the woven fabric 19, and thereby forming a looped surface 19*a*. During that time, the number of operation cycles of the weaving machine is counted continuously, and when the counted number of operation cycles reaches the preset value, the electromagnetic clutch 27 is disengaged again whereupon the operation is changed from the looped-surface producing mode to the loop-free surface producing mode. The respective lengths of the loop-forming surface 19*a* and the loop-free surface 19*b* can be readily changed by properly setting the preset count number of the counter.

The surface fastener is generally composed of a male member or hooked tape having a multiplicity of hook-shaped interlocking elements, which are formed by cutting partially away the warp pile loops formed from monofilaments, and a female member or looped tape having a multiplicity of looped interlocking elements formed by warp pile loops composed of multifilaments. According to the loop-forming apparatus of the present invention, it is possible to form the warp pile loops for forming the hook-shaped interlocking elements and the warp pile loops forming the looped interlocking elements either alone or mixedly. Alternately, these two pile loops can be formed alternately in the weaving direction along respective predetermined lengths of the woven fabric 19.

Figure 5:
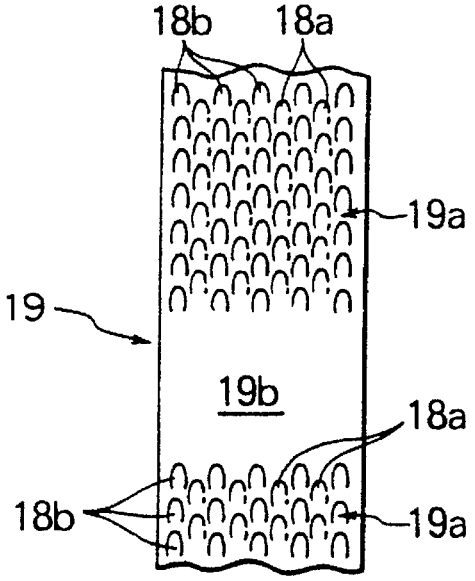
FIG. 5 is a fragmentary plan view of another surface fastener tape produced by the apparatus.

In the embodiment described above, when hook-shaped interlocking elements 18*a* or looped interlocking elements 18*b* are to be formed alone on the ground structure of a woven fabric 19, loop-forming warp threads 9 which are composed of either monofilaments or multifilaments are used. A blank web of surface fastener having a structure shown in FIG. 4 can thus be obtained. As an alternative, when the hook-shaped interlocking elements 18*a* and the looped interlocking elements 18*b* are to be formed mixedly on the ground structure of the woven fabric 19, as shown in FIG. 5, a first group of loop-forming warp threads 9 composed of monofilaments and a second group of loop-forming warp threads 9 composed of multifilaments are used concurrently. In this instance, it is preferable to use two leno deflectors, one or, the first leno deflector 5*a* used exclusively for forming the pile loops which are in turn cut into hooks such as the hook-shaped interlocking elements 18*a*, and the other or second leno deflector 5*b* used exclusively for forming pile loops such as the pile loops forming the looped interlocking elements 18*b*. In other words, the eyelets 8 of the first leno deflector 5*a* receive the loop-forming warp threads 9 composed of monofilaments, while the eyelets 8 of the second leno deflector 5*b* receive the loop-forming warp threads 9 composed of multifilaments. A surface fastener thus produced has a structure shown, for example, in FIG. 4.

Figure 6:
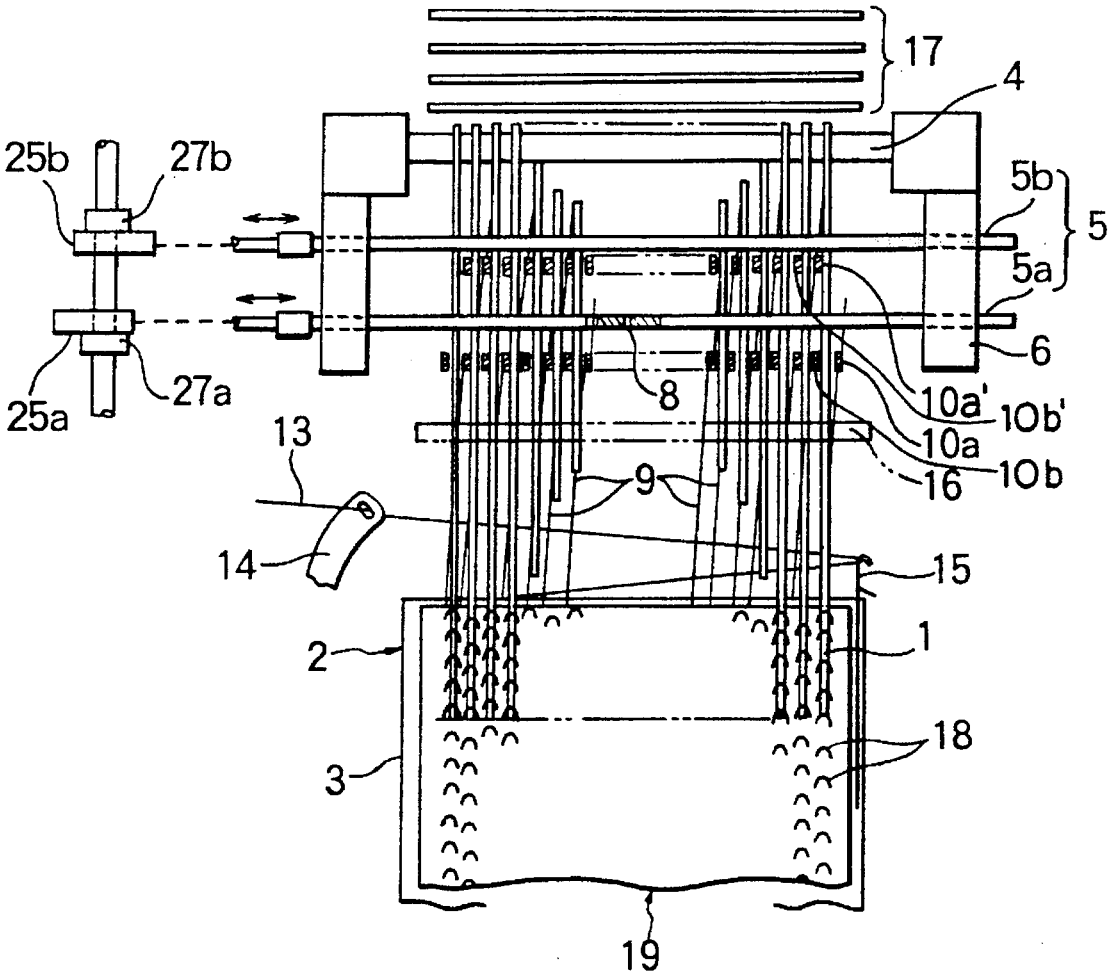
FIG. 6 is a schematic plan view of a main portion of a loop-forming apparatus according to another embodiment of the present invention.
Figure 7:
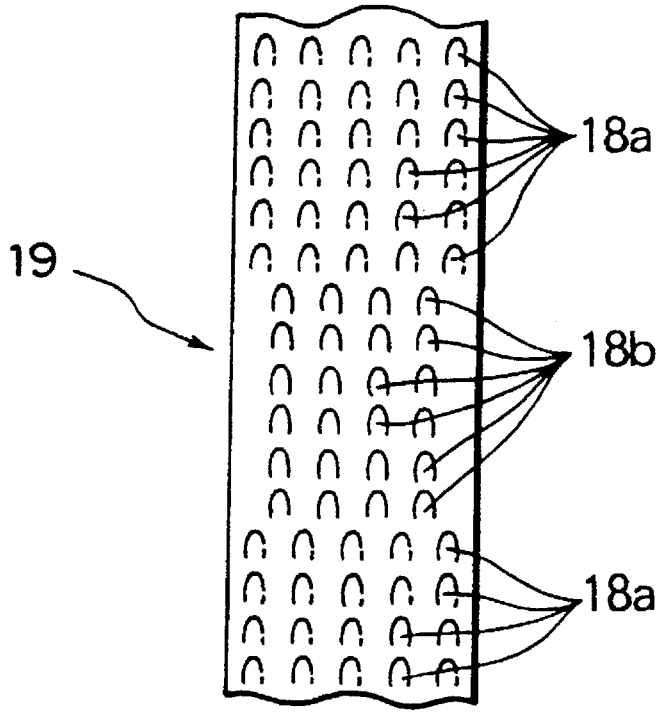
FIG. 7 is a fragmentary plan view of a surface fastener tape produced by the apparatus of FIG. 6.

When the hook-shaped interlocking elements 18*a* and the looped interlocking elements 18*b* are to be formed alternately in the weaving direction along respective predetermined lengths of the woven fabric 19, as shown in FIG. 7, a loop-forming apparatus constructed in accordance with another embodiment of the present invention such as shown in FIG. 6 is used. The apparatus of this embodiment differs from the apparatus of the first embodiment shown in FIGS. 1–3 in that a control unit is associated with each of the two leno deflectors to control the operation of the leno deflectors independently such as two electromagnetic clutches 27*a*, 27*b* which are operatively associated with the driving cams 25*a*, 25*b*, respectively, to selectively start and stop rotation of the driving cams 25*a*, 25*b*. Especially when a blank web of surface fastener shown in FIG. 7 is to be produced, each time the weaving machine completes predetermined cycles of operation, the leno deflector drive control unit 28 (see FIG. 1) sends a signal to the electromagnetic clutches 27*a*, 27*b* to energize them alternately to rotate a corresponding one of the driving cams 25*a*, 25*b* while holding the other driving cam stationary. In other words, one of two leno deflectors, through which a plurality of loop forming warp threads of monofilaments are threaded, is reciprocated repeatedly while the other leno deflector is held stationary. Reciprocating movement of the same leno deflector is stopped when predetermined cycles of reciprocation are complete, whereupon the other leno deflector is reciprocated until it completes predetermined cycles of reciprocation.

It is apparent from the foregoing description that according to the loop-forming apparatus of the present invention, at:least one leno deflector and a plurality of pairs of spaced gates hooks are used to engage loop-forming warp threads around corresponding mandrels to form loops of the threads. As against the conventional apparatus using a leno heald unit, the apparatus of this invention is completely free from an objectionable mutual interference of operative parts and hence is able to achieve follow a high speed operation of the weaving machine. Furthermore, since a plurality of loop-forming warp threads are dealt with a single leno deflector, the apparatus has a relatively small number of component parts and hence is simple in construction. The loop-forming warp threads are kept free from mutual interference. The apparatus further has a simple mechanism which is capable of intermittently reciprocating one or more leno deflectors in various controlled manners to ensure that a loop-forming surface and a loop-free surface can be formed alternately over given areas, pile loops used for forming hook-shaped interlocking elements and pile loops forming looped interlocking elements can be formed alternately, or pile loops used for forming hook-shaped interlocking elements and pile loops solely forming looped interlocking elements can be formed mixedly on the same loop-forming surface, without involving an unnecessary increase in the equipment cost.

Obviously, various minor changes and modifications of the present invention are possible in the light of the above teaching. It is therefore to be understood that within the scope of the appended claims the invention may be practiced otherwise than as specifically described.

What is claimed is:

1. A loop-forming apparatus in a weaving machine for weaving a web of pile fabric comprising:

a plurality of parallel spaced loop-forming mandrels each extending forwardly between and in parallel to a corresponding adjacent pair of ground warp threads beyond a cloth fell of the weaving machine;

at least one leno deflector extending transversely of the mandrels between the cloth fell and a harness of the weaving machine and reciprocally movable in a substantially transverse direction to that of the length of the mandrel so as to deflect the course of loop-forming warp threads alternately to one side and then to the other side of the mandrels, respectively;

a plurality of pairs of spaced gate hooks each pair extending vertically at opposite sides of a corresponding one of the mandrels, each pair of the gate hooks being vertically reciprocable in timed relation to said leno deflector to capture and lower the deflected loop-forming warp thread alternately to opposite sides of the corresponding one mandrel so as to pass the loop-forming warp thread over the corresponding one mandrel in a staggering fashion to thereby form pile loops on a woven fabric; the improvement comprising operation control means for intermittently controlling the reciprocating operation of said leno deflector at given intervals of time for forming first areas having pile loops and second areas having no pile loops along a length of said woven fabric.

2. A loop-forming apparatus according to claim 1, wherein the number of said leno deflectors is plural, said plural leno deflectors being disposed in parallel juxtaposition and driven independently of one another at respective given intervals of time under the control of said operation control means.

3. A loop-forming apparatus in a weaving machine for weaving a web of pile fabric comprising:

a plurality of parallel spaced loop-forming mandrels each extending forwardly between and in parallel to a corresponding adjacent pair of ground warp threads beyond a cloth fell of the weaving machine;

at least one leno deflector extending transversely of the mandrels between the cloth fell and a harness of the weaving machine and reciprocal movable in a substantially transverse direction to that of the length of the mandrel so as to deflect the course of loop-forming warp threads alternately to one side and then to the other side of the mandrels, respectively;

a plurality of pairs of spaced gate hooks each pair extending vertically at opposite sides of a corresponding one of the mandrels, each pair of the gate hooks being vertically reciprocable in timed relation to said leno deflector to capture and lower the deflected loop-forming warp thread alternately to opposite sides of the corresponding one mandrel so as to pass the loop-forming warp thread over the corresponding one mandrel in a staggering fashion to thereby form pile loops on a woven fabric; the improvement comprising operation control means for intermittently controlling the reciprocating operation of said leno deflector at given intervals of time;

wherein said leno deflector is reciprocally driven by a cam mechanism operatively coupled with a rotating power source, and said operation control means includes a clutch mechanism disposed between said rotating power source and said cam mechanism, and clutch control means for arbitrarily controlling engaging and disengaging time periods of said clutch mechanism.

4. A loop-forming apparatus in a weaving machine for weaving a web of pile fabric comprising:

a plurality of parallel spaced loop-forming mandrels each extending forwardly between and in parallel to a corresponding adjacent pair of ground warp threads beyond a cloth fell of the weaving machine;

at least one leno deflector extending transversely of the mandrels between the cloth fell and a harness of the weaving machine and reciprocally movable in a substantially transverse direction to that of the length of the mandrel so as to deflect the course of loop-forming warp threads alternately to one side and then to the other side of the mandrels, respectively;

a plurality of pairs of spaced gate hooks each pair extending vertically at opposite sides of a corresponding one of the mandrels, each pair of the gate hooks being vertically reciprocable in timed relation to said leno deflector to capture and lower the deflected loop-forming warp thread alternately to opposite sides of the corresponding one mandrel so as to pass the loop-forming warp thread over the corresponding one mandrel in a staggering fashion to thereby form pile loops on a woven fabric; the improvement comprising operation control means for intermittently controlling the reciprocating operation of said leno deflector at given intervals of time;

wherein said leno deflector is reciprocally driven by an electromagnetic driving means, and said operation control means includes an electromagnetic operation control means for arbitrarily controlling an operating time period of said electromagnetic driving means.

5. A loop-forming apparatus in a weaving machine for weaving a web of pile fabric comprising:

a plurality of parallel spaced loop-forming mandrels each extending forwardly between and in parallel to a corresponding adjacent pair of ground warp threads beyond a cloth fell of the weaving machine;

at least one leno deflector extending transversely of the mandrels between the cloth fell and a harness of the weaving machine and reciprocally movable in a substantially transverse direction to that of the length of the mandrel so as to deflect the course of loop-forming warp threads alternately to one side and then to the other side of the mandrels, respectively;

a plurality of pairs of spaced gate hooks each pair extending vertically at opposite sides of a corresponding one of the mandrels, each pair of the gate hooks being vertically reciprocable in timed relation to said leno deflector to capture and lower the deflected loop-forming warp thread alternately to opposite sides of the corresponding one mandrel so as to pass the loop-forming warp thread over the corresponding one mandrel in a staggering fashion to thereby form pile loops on a woven fabric; the improvement comprising operation control means for intermittently controlling the reciprocating operation of said leno deflector at given intervals of time;

wherein said operation control means and said leno deflector are arranged for said vertical reciprocating motion of said gate hooks to be maintained while reciprocating motion of said leno deflector is stopped.

6. A loop-forming apparatus in a weaving machine for weaving a web of pile fabric comprising:

a plurality of parallel spaced loop-forming mandrels each extending forwardly between and in parallel to a corresponding adjacent pair of ground warp threads beyond a cloth fell of the weaving machine;

at least one leno deflector extending transversely of the mandrels between the cloth fell and a harness of the weaving machine and reciprocally movable in a substantially transverse direction to that of the length of the mandrel so as to deflect the course of loop-forming warp threads alternately to one side and then to the other side of the mandrels, respectively;

a plurality of pairs of spaced gate hooks each pair extending vertically at opposite sides of a corresponding one of the mandrels, each pair of the gate hooks being vertically reciprocable in timed relation to said leno deflector to capture and lower the deflected loop-forming warp thread alternately to opposite sides of the corresponding one mandrel so as to pass the loop-forming warp thread over the corresponding one mandrel in a staggering fashion to thereby form pile loops on a woven fabric; the improvement comprising operation control means for intermittently controlling the reciprocating operation of said leno deflector at given intervals of time;

wherein the number of said leno deflectors is plural, said plural leno deflectors being disposed in parallel juxtaposition and driven independently of one another at respective given intervals of time under the control of said operation control means; and wherein the loop-forming warp threads threaded through said leno deflectors are all composed of monofilaments or multifilaments.

7. A loop-forming apparatus in a weaving machine for weaving a web of pile fabric comprising:

a plurality of parallel spaced loop-forming mandrels each extending forwardly between and in parallel to a corresponding adjacent pair of ground warp threads beyond a cloth fell of the weaving machine;

at least one leno deflector extending transversely of the mandrels between the cloth fell and a harness of the weaving machine and reciprocally movable in a substantially transverse direction to that of the length of the mandrel so as to deflect the course of loop-forming warp threads alternately to one side and then to the other side of the mandrels, respectively;

a plurality of pairs of spaced gate hooks each pair extending vertically at opposite sides of a corresponding one of the mandrels, each pair of the gate hooks being vertically reciprocable in timed relation to said leno deflector to capture and lower the deflected loop-forming warp thread alternately to opposite sides of the corresponding one mandrel so as to pass the loop-forming warp thread over the corresponding one mandrel in a staggering fashion to thereby form pile loops on a woven fabric; the improvement comprising operation control means for intermittently controlling the reciprocating operation of said leno deflector at given intervals of time;

wherein the number of said leno deflectors is plural, said plural leno deflectors being disposed in parallel juxtaposition and driven independently of one another at respective given intervals of time under the control of said operation control means; and wherein a first group of the loop-forming warp threads threaded through one of said leno deflectors are composed of monofilaments, and a second group of the loop-forming warp threads threaded through an adjacent one of the leno deflectors are composed of multifilaments.

* * * * *